US009895719B2

(12) United States Patent
Wess

(10) Patent No.: US 9,895,719 B2
(45) Date of Patent: Feb. 20, 2018

(54) SORTING ELEMENT FOR A SORTING DEVICE

(71) Applicant: Günther Holding GmbH & Co. KG, Wartenberg (DE)

(72) Inventor: Markus Wess, Eichenzell-Kerzell (DE)

(73) Assignee: GÜNTHER HOLDING GMBH & CO. KG, Wartenberg (DE)

( * ) Notice: Subject to any disclaimer, the term of this patent is extended or adjusted under 35 U.S.C. 154(b) by 0 days.

(21) Appl. No.: 14/759,800

(22) PCT Filed: Dec. 20, 2013

(86) PCT No.: PCT/EP2013/077721
§ 371 (c)(1),
(2) Date: Jul. 8, 2015

(87) PCT Pub. No.: WO2014/108307
PCT Pub. Date: Jul. 17, 2014

(65) Prior Publication Data

US 2015/0336133 A1 Nov. 26, 2015

(30) Foreign Application Priority Data

Jan. 10, 2013 (DE) ..... 10 2013 100 209

(51) Int. Cl.
*B07B 13/00* (2006.01)
*B07B 1/15* (2006.01)

(52) U.S. Cl.
CPC ..... *B07B 1/155* (2013.01)

(58) Field of Classification Search
CPC ..... B07B 1/14; B07B 1/155
USPC ..... 209/669
See application file for complete search history.

(56) References Cited

U.S. PATENT DOCUMENTS 3,217,346 A * 11/1965 Silver ..... B07B 1/15 15/3.11
4,356,085 A 10/1982 Schon et al.
4,613,087 A * 9/1986 Snyder ..... B02C 18/142 241/111
5,425,459 A * 6/1995 Ellis ..... A01D 17/06 209/667
5,653,633 A * 8/1997 Kalverkamp ..... A01D 17/10 198/631.1

(Continued)

FOREIGN PATENT DOCUMENTS

CN 101758019 A 6/2010
CN 201702098 U 1/2011

(Continued)

OTHER PUBLICATIONS

International Preliminary Report on Patentability dated Jul. 14, 2015 in International Patent Application No. PCT/EP2013/077721 (7 pages).

(Continued)

*Primary Examiner* — Terrell Matthews
(74) *Attorney, Agent, or Firm* — Massina Pat. & TM Law PLLC

(57) ABSTRACT

The invention relates to a sorting element for a sorting device. The sorting element comprises a substrate from which a multitude of fingers project. The fingers are arranged on the substrate along a first helical line.

28 Claims, 8 Drawing Sheets

(56) References Cited

U.S. PATENT DOCUMENTS

| | | | | |
|---|---|---|---|---|
| 6,241,100 | B1 * | 6/2001 | Tanner | B07B 1/155 209/667 |
| 6,425,749 | B1 | 7/2002 | Lettner et al. | |
| 6,848,583 | B2 * | 2/2005 | Largent | B01D 33/0307 209/234 |
| 6,953,166 | B2 | 10/2005 | Schenk | |
| 7,578,396 | B1 * | 8/2009 | Garzon | B07B 1/15 209/660 |
| 8,646,615 | B2 * | 2/2014 | Bruggencate | B07B 1/15 209/665 |
| 9,498,797 | B2 * | 11/2016 | Guenther | B07B 1/005 |
| 2006/0226054 | A1 * | 10/2006 | Bishop, Jr. | B07B 1/15 209/667 |
| 2010/0206783 | A1 * | 8/2010 | Visscher | B07B 1/14 209/699 |
| 2015/0165480 | A1 * | 6/2015 | Parr | B07B 1/15 209/672 |
| 2015/0290681 | A1 * | 10/2015 | Guenther | E02F 7/06 37/444 |
| 2015/0306633 | A1 * | 10/2015 | Guenther | B07B 1/005 209/3 |

FOREIGN PATENT DOCUMENTS

| | | | |
|---|---|---|---|
| CN | 202290541 | U | 7/2012 |
| DE | 297 19 874 | U1 | 12/1997 |
| DE | 199 14 269 | A1 | 10/2000 |
| DE | 201 08 463 | U1 | 10/2001 |
| DE | 20 2012 005 012 | U1 | 6/2012 |
| DE | 10 2013 100 209 | B3 | 5/2014 |
| EP | 0 034 780 | A2 | 9/1981 |
| EP | 1570919 | A1 | 9/2005 |
| EP | 2223587 | A1 | 9/2010 |
| GB | 2267235 | A | 12/1993 |
| GB | 2380116 | A | 4/2003 |

OTHER PUBLICATIONS

Office Action dated Jun. 12, 2017 in connection with European patent application 13811973.0.

Office Action dated May 31, 2015 in connection with German patent applciation 10 2013 100 209.9 (5 pages).

Office Action dated May 30, 2016 in connection with Chinese patent application 201380069695.2, with English language translation (15 pages).

* cited by examiner

SORTING ELEMENT FOR A SORTING DEVICE

FIELD OF THE INVENTION

The invention relates to a sorting element for a sorting device.

BACKGROUND

A multitude of sorting devices for separating variously dimensioned materials are known from the prior art. EP 1 570 919 A1, for instance, discloses a sorting device for sorting substantially solid materials. In one specific embodiment of this sorting device, material to be separated is introduced, via a feed belt and at a particular angle, onto a plurality of spiral rollers which are driven in the same rotational direction. The material is conveyed in the longitudinal direction by a runway effect and simultaneously sideways by the spiral helix, wherein any parts which are smaller than the intermediate spaces, which are predetermined by the design, fall down between the spiral helices. Long, thin parts are discharged in the rotational direction and thick, cubical shaped parts are discharged via the freely terminating shaft ends. The so-called fine grain which falls through the intermediate spaces can be directly transported away by suitable conveyor belts below the spiral rollers, as can the two coarse materials.

One disadvantage of the aforesaid sorting device is that it exhibits poor transport characteristics in the case of light materials.

DE 20 2012 005 012 U1 discloses a screen star which comprises a multitude of fingers. The fingers are arranged along a circular line on a substrate of the screen star. DE 297 19 874 U1 discloses a star wheel which comprises two groups of fingers, wherein fingers of a first group are arranged such that they are offset in the circumferential direction with respect to fingers of a second group. EP 2 223 587 A1 and GB 2 267 235 A each disclose a helical roller.

SUMMARY

It is an object of the invention to provide a sorting element which, when used in a sorting device, enables light materials to be superiorly transported and/or sorted. It is also an object of the invention to provide a helical roller and a corresponding sorting device comprising a sorting element.

In accordance with the invention, the sorting element comprises a substrate from which a multitude of fingers project. The fingers can project in the radial direction. The fingers are arranged on the substrate along a first helical line. The first helical line can extend around a substrate axis, in particular a centre axis of the substrate. The substrate can be embodied to be circular in cross-section. In particular, the ends of the fingers which face and/or face away from the substrate can be arranged along the first helical line. Alternatively or additionally, the centres of gravity of the fingers can be arranged along the first helical line.

The advantage of the aforesaid sorting element is that when it is used in a sorting device, it is easily possible to transport and sort light materials. This is enabled by the design of the sorting element, in particular by arranging the fingers on the substrate along the first helical line. The fingers ensure that long parts are transported in the rotational direction of the helical roller. The arrangement of the fingers also ensures that thick, cubical shaped parts are discharged via the freely terminating ends of the helical roller.

Another advantage of the sorting element is that, due to the aforesaid arrangement of the fingers and contrary to star screens or disc screens, the flanks of the fingers are not parallel to each other. The problem can arise with star screens and disc screens that when sticky material is being sorted, it remains stuck to the star screens or disc screens, consequently producing discs which can rub against each other and ultimately bring the sorting device to a halt. If the fingers are arranged on the substrate along the first helical line, this problem cannot arise, since transverse movements in an axial direction of the substrate occur which has a self-cleaning effect.

In a preferred embodiment, adjacent fingers can be separated from each other by a cavity. The fingers can be formed from an elastic material. Within the meaning of the invention, an elastic material is understood to mean a material which is embodied such that it is ensured that the finger yields or is deformed when it is charged with the material to be sorted and returns to its original position after it has been charged. The substrate and/or the fingers can be formed from rubber, plastic such as for example polyurethane, metal or another elastic material. The fingers can for instance be formed from spring steel.

The fingers can also be embodied to be sickle-shaped. Alternatively or additionally, a direction of curvature of the fingers can be directed oppositely to a rotational direction of the sorting element. Embodying the fingers as described above can ensure a good sorting result. A transition region between the fingers and the substrate can also be rounded. The sorting element can be configured such that exactly one revolution of the fingers is provided. This is advantageous with respect to removing cast parts and injection-moulded parts from the mould.

The sorting element can be embodied such that it comprises fingers which are arranged along a second helical line. The second helical line can extend around the centre axis of the substrate and can be arranged offset, in particular in the longitudinal direction of the substrate, with respect to the first helical line.

The substrate can comprise a hole for coupling to a shaft of a helical roller. The hole can be embodied as a multi-edged figure in cross-section. Alternatively, the hole can be embodied to be polygonal in cross-section. This enables a positive-fit connection between the sorting element and the shaft of the helical roller to be easily realised. By embodying the hole in this way, it is in particular easily possible to ensure that a relative rotation between the sorting element and the shaft is not possible.

An insert, which accommodates at least a part of the shaft of the helical roller, can be arranged in the hole of the substrate. The insert can consist of a more rigid material than the sorting element, in particular the substrate. The insert affords the advantage that it enables the sorting elements to be exactly aligned on the shaft of the helical roller, in order for example to prevent fingers of sorting elements arranged on adjacent helical rollers from hitting each other. This would not be possible without the insert, when the substrate consists of an elastic material.

The insert can be a rod which is introduced into the hole of the substrate. Alternatively, the insert can comprise at least two plates which are connected to each other. The plates can be at least substantially perpendicular to each other. The exact embodiment of the two plates with respect to each other depends on the contour of the hole. The two plates are for instance substantially perpendicular to each other if the cavity is a quadrilateral. This means that an angle between the two plates depends on an interior angle which is formed by two adjacent edges of the hole. Forming the insert using two plates affords the advantage that it can be easily and securely introduced into the hole.

Cavities can also be provided in the insert, through which the elastic material of the substrate can penetrate when the insert is inserted into the cavity of the substrate. This enables the insert to be easily fixed within the hole. The plates can also be connected to each other such that they are arranged offset with respect to each other in the axial direction. The two plates can also have a bend at their end which is at a distance from the connection. When the insert has been incorporated into the hole, the bend penetrates into the substrate, thus additionally fixing the insert in the substrate.

In a preferred embodiment, a first protrusion which extends in the axial direction of the substrate can protrude from a first side-face of the substrate. Alternatively or additionally, a second protrusion which extends in the axial direction of the substrate can protrude from a second side-face of the substrate, in particular the same substrate. Providing the first and/or second protrusion enables the sorting elements to be easily assembled on the shaft of the helical roller. The first and second protrusion can be arranged on different sides of the substrate in relation to a centre plane of the substrate.

Within the meaning of the invention, centre plane is understood to mean a plane which contains the substrate axis. The first and/or second protrusion can be embodied and/or positioned such that wraps have little chance of being drawn into the point of separation.

The first and/or second protrusion can also comprise at least one and in particular two contact area(s), wherein when two sorting elements are assembled, one of the first and second protrusion of the first sorting element can be brought into contact, via a first contact surface, with a first contact surface of the other of the first and second protrusion of a second, adjacent sorting element. The first and/or second protrusion of the first sorting element can comprise a second contact surface which can be brought into contact with the base body of an adjacent sorting element. The second contact surface can be arranged at least substantially perpendicular to the first contact surface.

The protrusion can be shaped in any way as long as it is ensured that the embodiment of the protrusion enables a rotationally fixed connection between sorting elements which are adjacent in the axial direction of the helical roller.

The substrate which is provided with only one protrusion can be a start or end piece of the sorting elements arranged on the helical roller. The start piece is arranged closest to a drive device of the sorting device, which is for example arranged in a housing, and the end piece is arranged furthest from the drive device.

In a preferred embodiment, the sorting element can comprise at least one finger which has a wear-resistant end. Such a finger exhibits the advantage that it can serve to clean an adjacent helical roller. The sorting element can also comprise a finger which is embodied to be longer than at least one other finger and in particular longer than any other fingers. This can also easily ensure that the helical roller is cleaned.

In accordance with another aspect of the invention, a helical roller for a sorting device can be provided which comprises at least one sorting element. At least two sorting elements can be arranged sequentially on the shaft of the helical roller along an axis of the helical roller. This segmented design of the helical roller affords the advantage that it can be manufactured economically. Another advantage is that the operating costs are low, since only the sorting elements which are actually worn down have to be exchanged and not therefore, as is usual in the prior art, the entire helical roller.

In particular when at least two sorting elements are arranged on the shaft, the first protrusion of the first sorting element can come into contact, for example via the first contact surface, with the first contact surface of the second protrusion of the second sorting element which is adjacent in the axial direction of the helical roller. This easily ensures that the sorting elements are coupled. The sorting elements arranged on the helical roller can also be coupled such that they are rotationally fixed relative to each other. The rotationally fixed coupling can for example be ensured by bringing the first protrusion of the first sorting element into contact with the second protrusion of the second sorting element, as mentioned above.

The shaft of the helical roller can be connected to the sorting element integrally. In order to establish the integral connection, the shaft can be welded, riveted, glued, etc. to the substrate. Alternatively, the shaft of the helical roller can correspond to the substrate of the sorting element. In this case, the fingers are attached directly to the shaft. The fingers can be screwed, welded, riveted, etc. to the substrate or to the shaft.

Alternatively, the fingers can be manufactured using a manufacturing method such as for example milling.

In accordance with another aspect of the invention, a sorting device is provided which comprises at least one sorting element as described above and/or at least one helical roller as described above. The sorting device can in particular comprise at least two helical rollers, each of which rotates about a rotary axis of its own and which have the same direction of rotation. The helical roller can be mounted exclusively at one end, which affords the advantage that easy access to the sorting device is provided. This also renders the sorting device unsusceptible to wraps and impurities, since they can easily be removed.

In the sorting device, at least two helical rollers can form a sorting surface. A resting zone for the material to be sorted can be on the sorting surface, wherein the resting zone is formed and/or extends transverse to an axis of the helical roller. This means that the material to be sorted is fed transverse to the axis of the helical roller. The distance between the axes of the helical rollers can be set. Two helical rollers can also be rotated relative to each other.

The sorting device can be embodied such that the sorting elements of two adjacent helical rollers interlock. The fingers of the sorting elements can be embodied, and/or the distance between the helical rollers can be selected, such that a finger of the sorting element of a first helical roller extends as far as a substrate of the sorting element of a second helical roller.

In a particular embodiment of the sorting device, at least two helical rollers can be provided which are embodied to be elliptical in cross-section. A main axis of a first elliptical helical roller can be provided such that it is rotated by a predetermined angle with respect to a main axis of a second elliptical helical roller which is adjacent to the first helical roller. The angle can measure at least substantially 90° and can be predetermined by a user of the sorting device. It will be clear that when the helical rollers are embodied to be elliptical, any adjacent helical rollers and in particular their main axes are arranged such that they are rotated with respect to each other. Embodying the helical roller to be elliptical affords the advantage that a lifting movement of the material to be sorted is performed, whereby it is superiorly transported and loosened.

An elliptical helical roller can also be realised by embodying the substrate and/or the shaft to be elliptical in cross-section. The fingers can exhibit the same length in relation to the substrate, such that an effective diameter of the fingers is embodied to be circular. If the substrate and/or shaft is embodied to be elliptical, an exterior diameter of the helical roller is embodied to be elliptical.

Alternatively, an elliptical helical roller can be realised by embodying the substrate and/or the shaft to be circular in cross-section. In this case, the fingers exhibit different lengths, such that their exterior diameter is embodied to be elliptical. This ensures that the exterior diameter of the helical roller is embodied to be elliptical.

The exterior diameter of the helical roller is defined by the ends of the fingers which are at a distance from the substrate. Within the meaning of the invention, the main axis is understood to mean the axis of the helical roller which connects the main vertices of the elliptical exterior diameter of the helical roller to each other.

The helical rollers of the sorting device can be driven at the same rotational speed.

BRIEF DESCRIPTION OF THE DRAWINGS

Other aims, advantages and possible applications of the present invention may be gathered from the following description of an example embodiment on the basis of the drawings.

There is shown.

DETAILED DESCRIPTION OF THE INVENTION

Figure 1:
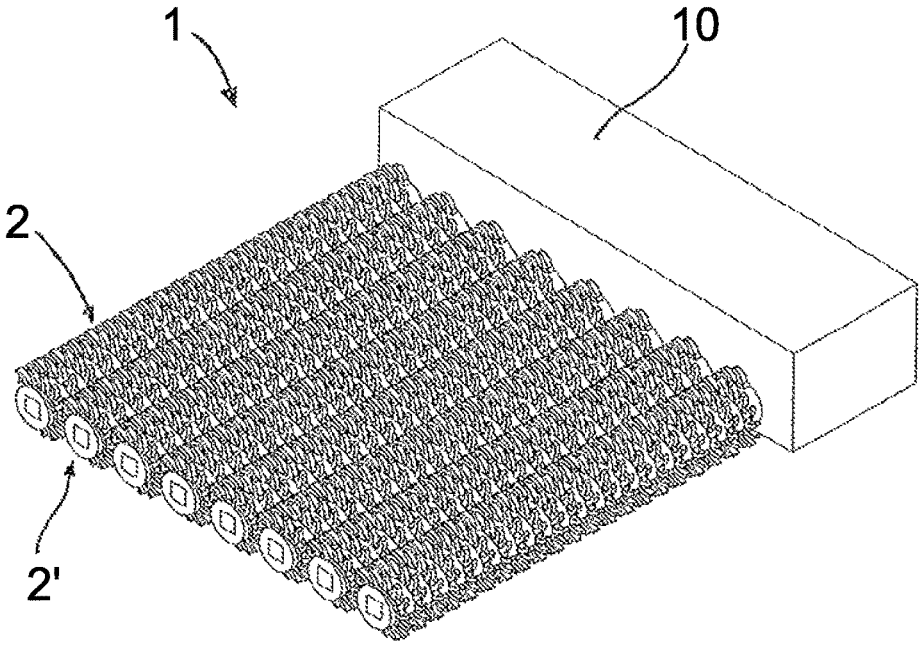
FIG. 1 a perspective representation of the sorting device in accordance with the invention.

The sorting device 1 shown in FIG. 1 comprises a housing 10 and a multitude of helical rollers 2, 2' in accordance with a first embodiment. The helical rollers 2, 2' are arranged parallel to each other and are mounted in the housing 10 exclusively at one end. A drive device (not shown) is arranged within the housing 10 and ensures that the helical rollers 2, 2' rotate about their respective rotary axis, wherein all the helical rollers 2, 2' have the same direction of rotation.

Figure 2:
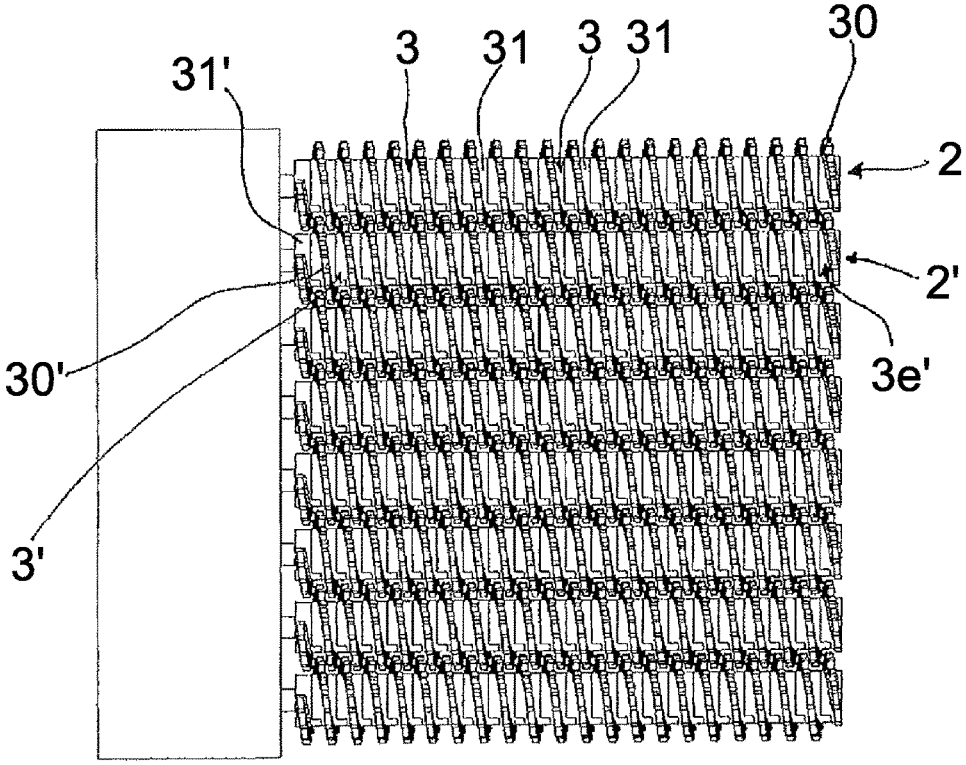
FIG. 2 a plan view onto the sorting device in accordance with the invention.

As can be seen from FIG. 2, the individual helical rollers 2, 2' each comprise a multitude of sorting elements 3, 3' which are arranged sequentially along an axis of the helical roller and are coupled to each other. The sorting elements 3, 3' each comprise a multitude of fingers 30, 30'. The fingers 30, 30' extend, in particular in the radial direction, from a substrate 31, 31' of the sorting element 3, 3'. The individual sorting elements 3, 3' are embodied such that the fingers 30, 30' extend along a helical line around the axis of the helical roller. The fingers 30, 30' are arranged such that a clockwise winding is established.

The sorting elements 3, 3' of two adjacent helical rollers 2, 2' interlock. The fingers 30 of a sorting element 3 on a first helical roller 2 are embodied such that they extend as far as a substrate 31' of a sorting element 3' arranged on a second helical roller 2' which is adjacent to the first helical roller 2. The helical rollers 2, 2' can be moved relative to each other such that a distance between the fingers 30 of the first helical roller 2 and the correspondingly opposite fingers 30' of the second helical roller 2' can be varied. The helical rollers 2, 2' can in particular be rotated relative to each other and/or moved axially in a direction along the axis of the helical roller, in order to vary the aforesaid distance.

Figure 3:
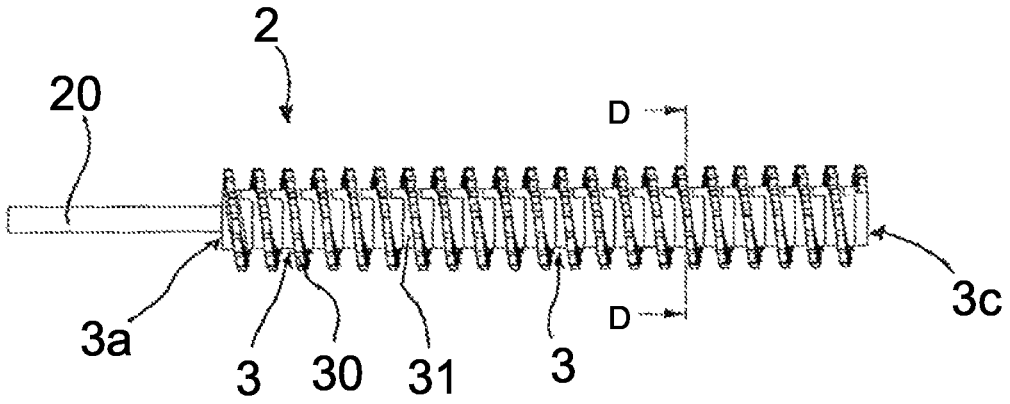
FIG. 3 a lateral view of the helical roller in accordance with the invention, in accordance with a first embodiment.

As can be seen from FIG. 3, the helical roller 2 consists of a shaft 20 which can be coupled to the sorting elements 3. The shaft 20 is mounted at one end in the housing 10 shown in FIG. 1. The shaft 20 is a multi-edged figure, in particular a quadrilateral, in cross-section. The embodiment of the shaft is not of course limited to that of a quadrilateral. The shaft 20 can for instance alternatively be a hexagon, octagon, toothed shaft or other polygonal shaft.

Figure 4:
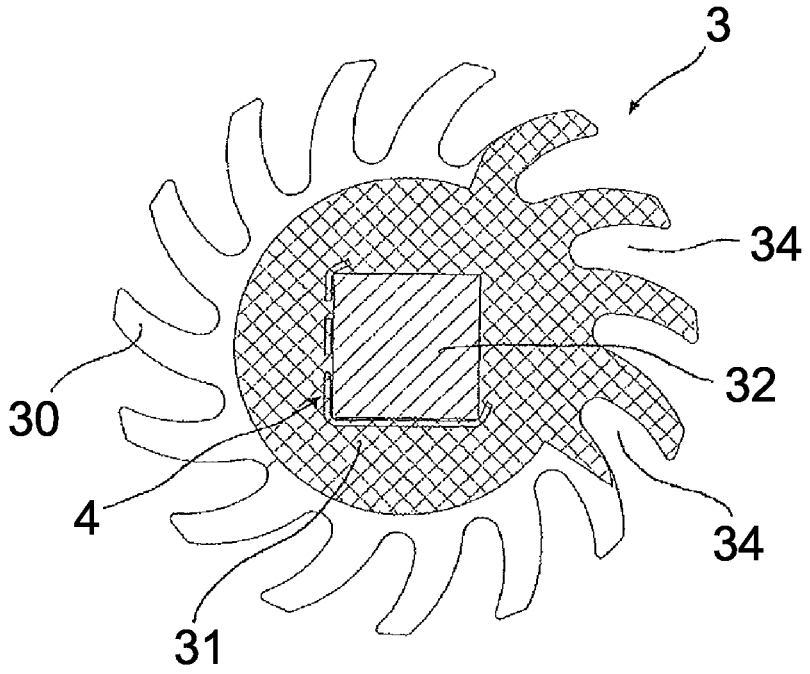
FIG. 4 a sectional view of the helical roller in accordance with the first embodiment, along the line D-D shown in FIG. 3.

As can be seen from FIG. 4, a hole 32 is provided in the substrate 31. The hole 32 is shaped so as to complement the shaft 20, such that when the shaft 20 is inserted into it, there is a positive-fit connection between the shaft 20 and the sorting element 3. An insert 4 is arranged within the hole 32, wherein the insert 4 abuts only a part of a wall of the hole. It can also be seen from FIG. 4 that the fingers 30 which are adjacent in the circumferential direction are separated from each other by a cavity 34.

Figure 5:
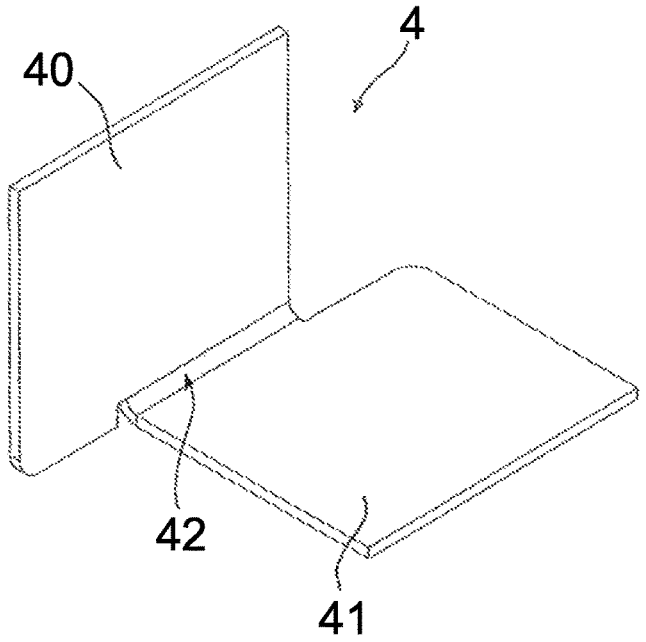
FIG. 5 a perspective representation of an insert in accordance with the invention, in accordance with a first embodiment.

FIG. 5 shows an insert 4 in accordance with a first embodiment. The insert 4 comprises two plates 40, 41 which are in particular rectangular and which are connected to each other on one side each in a connecting region 42. The two plates 40, 41 are arranged such that they are offset with respect to each other in the direction of the axis of the helical roller. This means that both the first and second plate 40, 41 comprise a portion which is adjacent to the connecting region 42 in the direction of the axis of the helical roller and not connected to the other plate.

Figure 6:
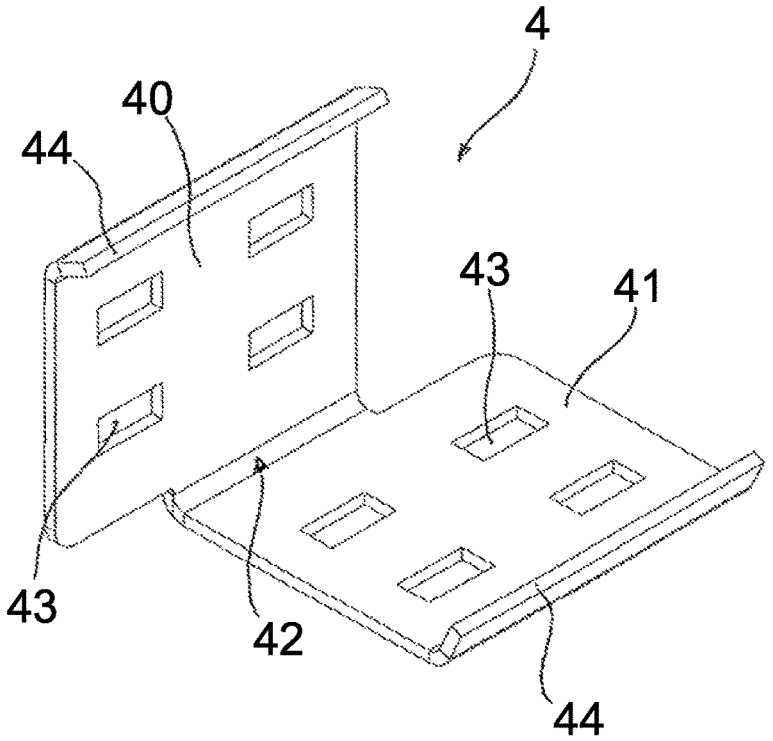
FIG. 6 a perspective representation of an insert in accordance with the invention, in accordance with a second embodiment.

FIG. 6 shows an insert 4 in accordance with a second embodiment, wherein components of the insert shown in FIG. 6 which correspond to components of the insert shown in FIG. 5 are provided with the same reference signs. A plurality of recesses 43 are provided in each of the first and second plate 40, 41. When the insert 4 is incorporated into the hole 32 of the substrate 31, substrate material can penetrate in through these recesses 43 and therefore fix the position of the insert 4 within the substrate 31. A bend 44 is provided at the end of each of the first and second plate 40, 41 which is at a distance from the connecting region 42. When incorporated into the substrate 31, the bend 44 penetrates into the substrate 31, as can be seen from FIG. 4, and additionally serves to fix the insert 4 in the substrate 31.

Figure 7:
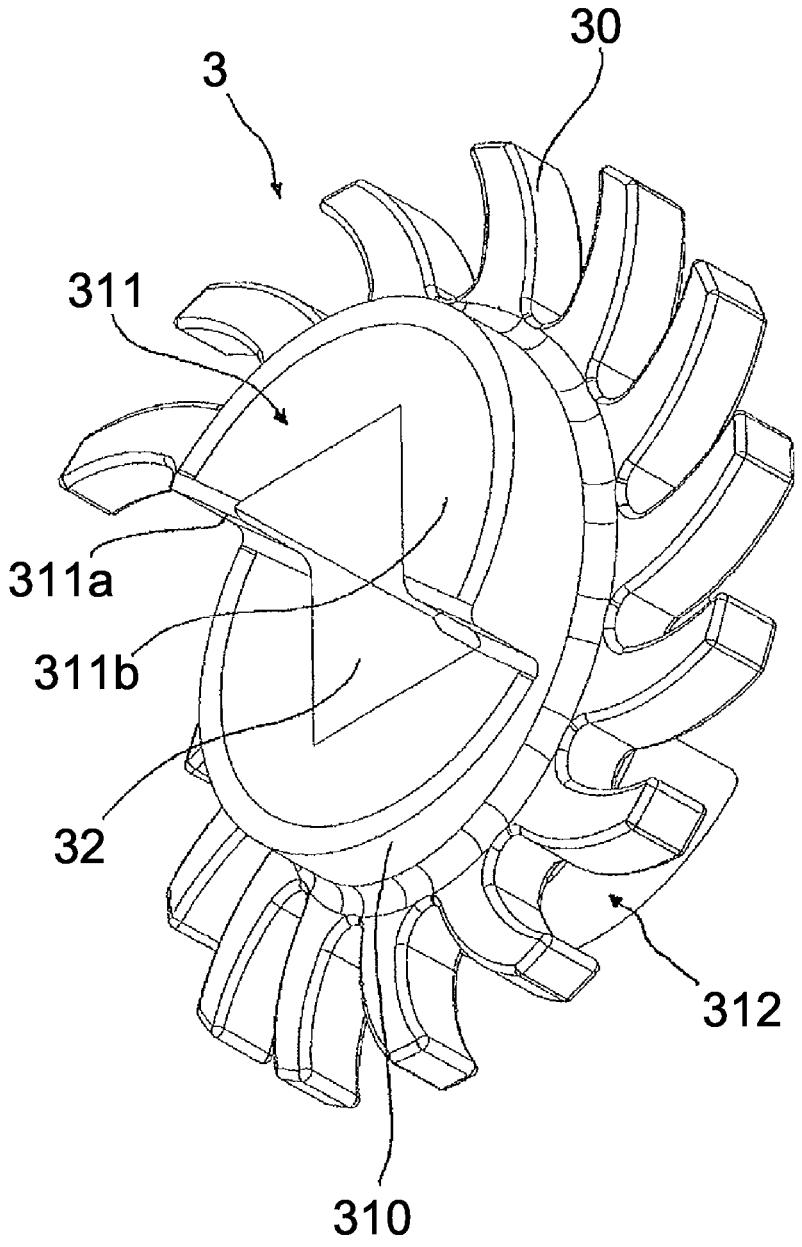
FIG. 7 a perspective representation of a sorting element in accordance with the invention.
Figure 8:
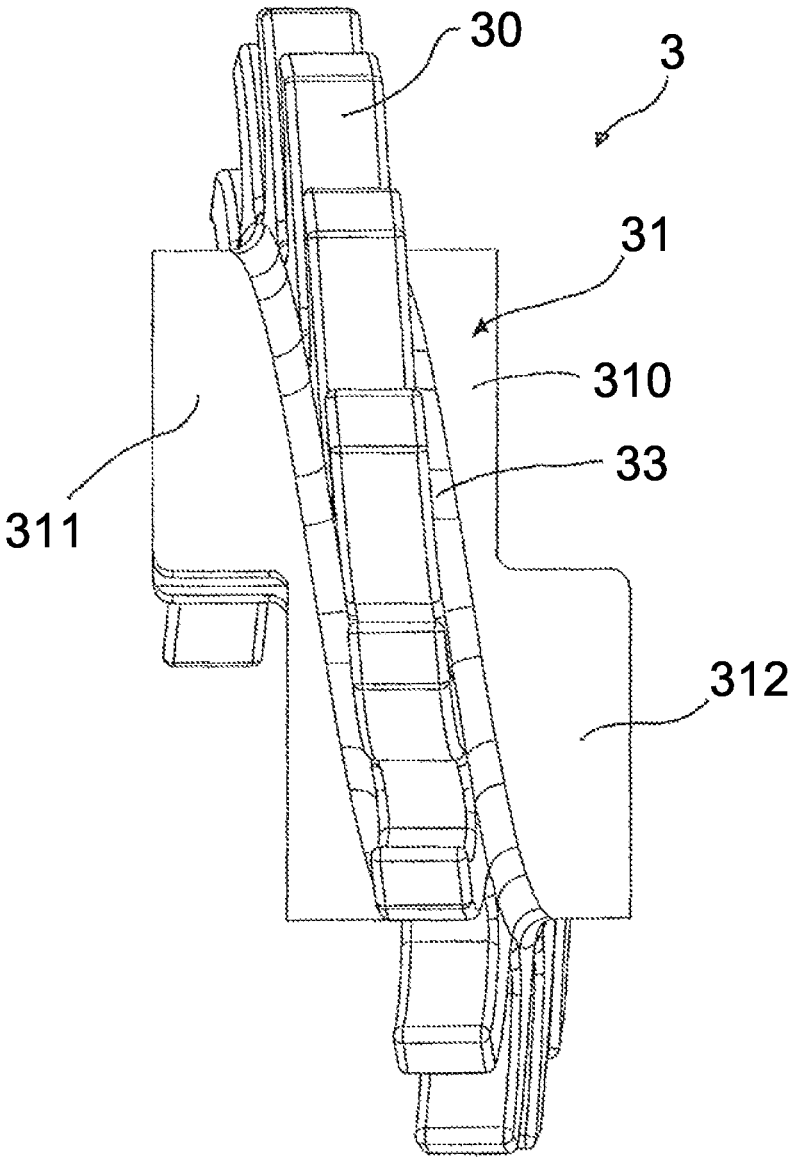
FIG. 8 a lateral view of a sorting element in accordance with the invention.

FIGS. 7 and 8 show a sorting element 3 which is coupled on each of its two side-faces to another sorting element which is adjacent in the axial direction of the helical roller. The fingers 30 of the sorting element 3 protrude from the substrate 31 in the radial direction and are arranged on it along a helical line. The helical line extends around a substrate axis which is coaxial with the axis of the helical roller when the sorting element 3 is connected to the shaft 20 of the helical roller 2. The fingers 30 are also embodied to be sickle-shaped, wherein the direction of curvature of the fingers 30 is opposite to a rotational direction of the helical roller. A transition region in which the fingers 30 are connected to the substrate 31 is rounded.

The substrate 31 comprises a first protrusion 311 on one side-face and a second protrusion 312 on another side-face, wherein the protrusions each extend from a base body 310 of the substrate 31 in the direction of the substrate axis, and the first protrusion 311 and the second protrusion 312 extend in opposite directions from the base body 310. The first and second protrusion 311, 312 are arranged on different sides of the substrate 31 in relation to a centre plane which contains the substrate axis.

Fingers 30 are provided on each of the first protrusion 311, the base body 310 and the second protrusion 312 and extend from them in the radial direction. The first protrusion 311 comprises two contact surfaces 311*a*, 311*b*. When two adjacent sorting elements 3 are coupled, the first protrusion 311 of one sorting element is placed, via a first contact surface 311*a*, onto a contact surface of a second protrusion of the adjacent sorting element. The sorting element also comes into contact, via a second contact surface 311*b*, with the base body 310 of the other sorting element 3.

Figure 9:
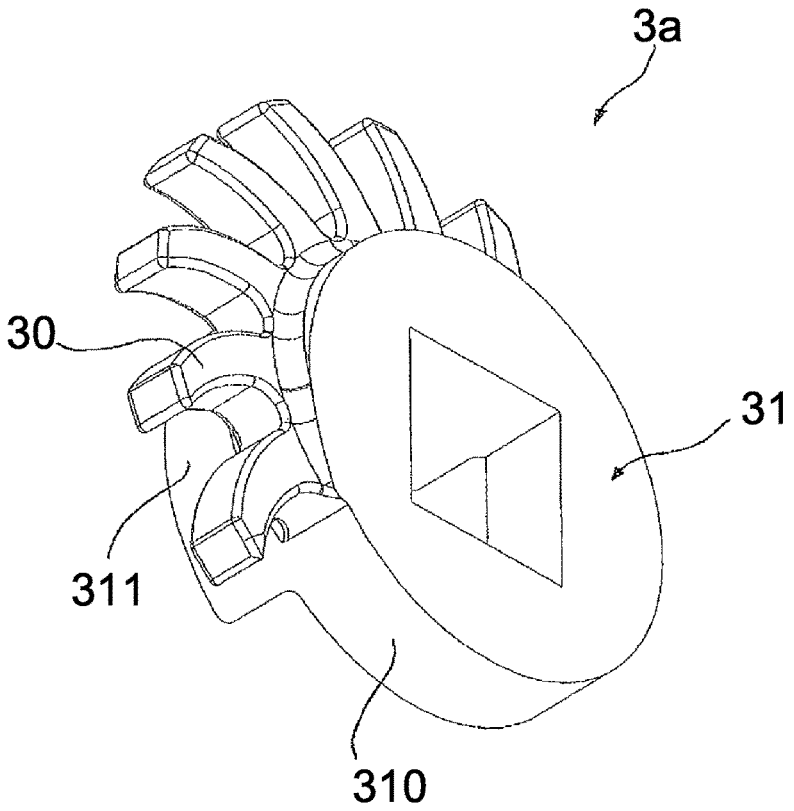
FIG. 9 a perspective representation of a sorting element in accordance with the invention, arranged at the start of the helical roller.
Figure 10:
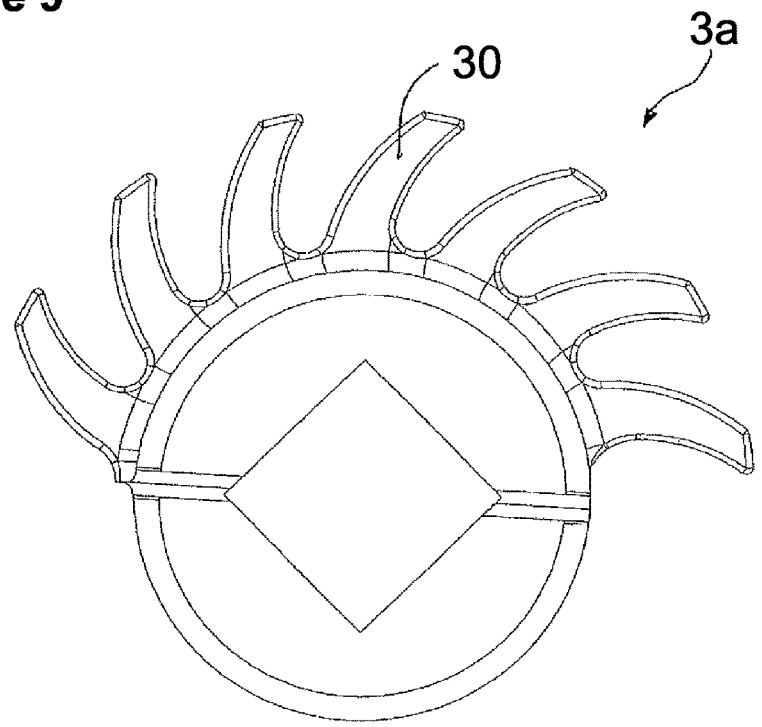
FIG. 10 a front view of a sorting element in accordance with the invention, arranged at the start of the helical roller.

FIGS. 9 and 10 show a sorting element 3*a* which is coupled on one side-face to another, adjacent sorting element 3, wherein the other sorting element 3 is the one shown in FIGS. 7 and 8. The sorting element 3*a* is a start piece of the helical roller 2 and is arranged closest of all the sorting elements 3 to the housing 10 of the sorting device. This embodiment differs from the embodiment shown in FIGS. 7 and 8 in that only a first protrusion 311 protrudes from the base body 310 in the direction of the substrate axis. The first protrusion 311 in particular protrudes from the base body 310 in a direction away from the housing 10. The end of the sorting element 3*a* which faces the housing 10 is embodied to be level.

Figure 11:
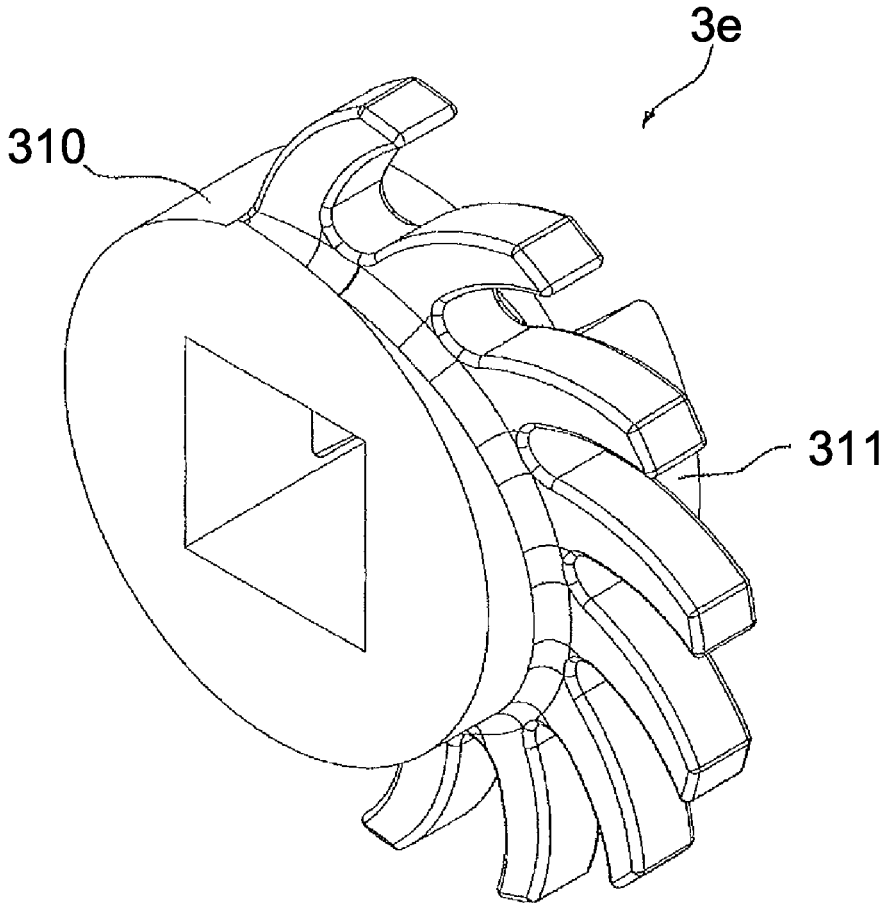
FIG. 11 a perspective representation of a sorting element in accordance with the invention, arranged at the end of the helical roller.
Figure 12:
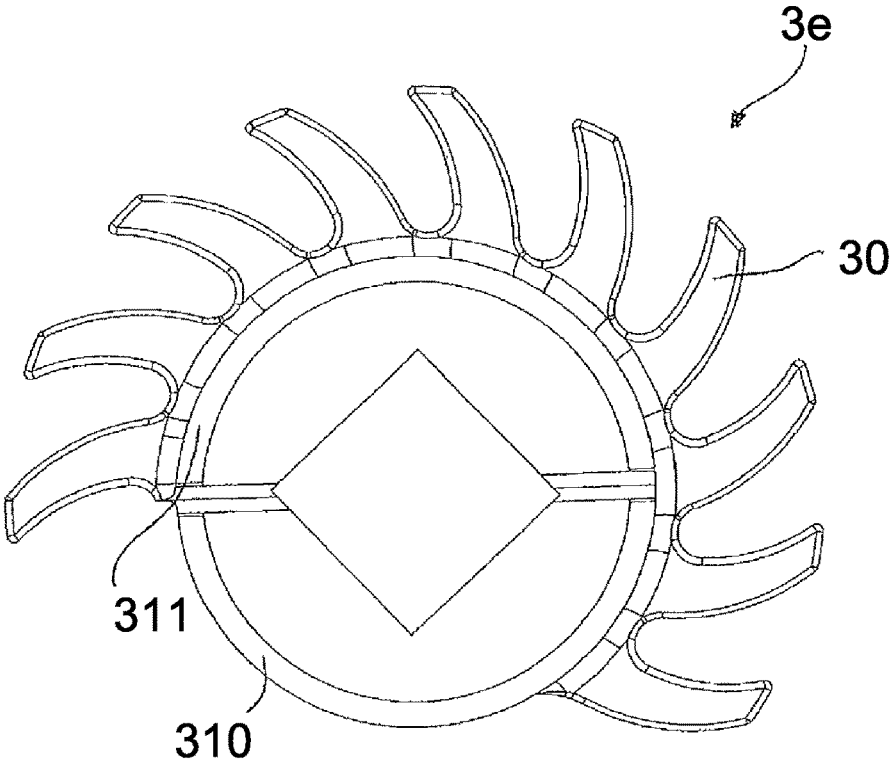
FIG. 12 a front view of a sorting element in accordance with the invention, arranged at the end of the helical roller.

FIGS. 11 and 12 show a sorting element 3*e* which, like the sorting element 3*a* shown in FIGS. 9 and 10, is coupled on one side-face to another, adjacent sorting element 3*a*, wherein the other sorting element 3 is the one shown in FIGS. 7 and 8. The difference with respect to the sorting element 3*a* shown in FIGS. 9 and 10 is that the sorting element 3*e* is an end piece of the helical roller 2 and is attached to the end of the helical roller 2 which faces away from the housing 10. In the sorting element 3*e*, only one first protrusion 311 extends from the base body 310 of the substrate. The first protrusion 311 does however extend from the base body 310 towards the housing 10.

Figure 13:
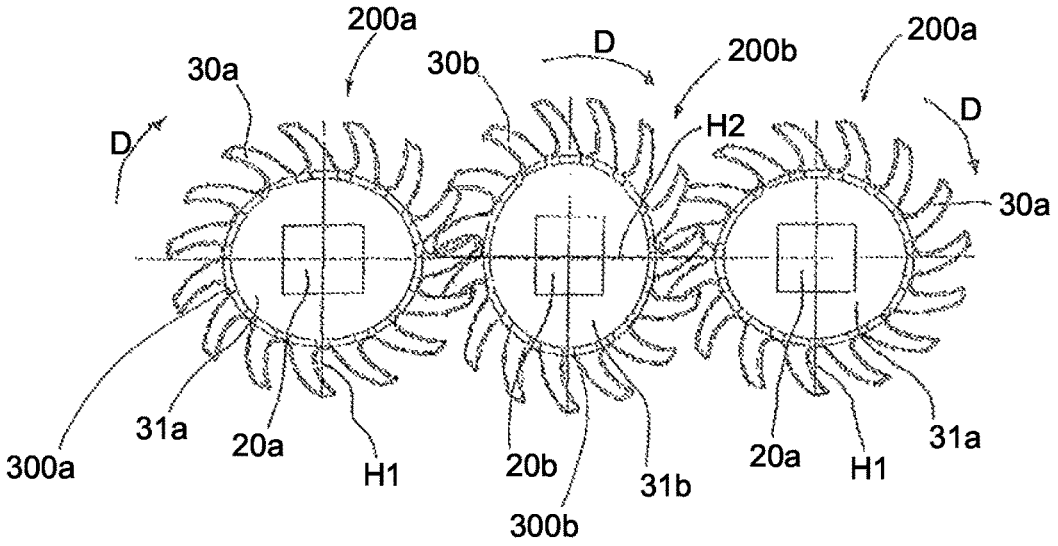
FIG. 13 a lateral view of three helical rollers in accordance with a second embodiment.

FIG. 13 shows a lateral view of three helical rollers 200*a*, 200*b* in accordance with a second embodiment. A first and second helical roller 200*a*, 200*b* are arranged adjacently to each other on a sorting device (not shown) and rotated in the rotational direction D, wherein the sorting elements 300*a*, 300*b* of the two adjacent helical rollers 200*a*, 200*b* interlock.

The helical rollers 200*a*, 200*b* are also embodied to be elliptical in cross-section, wherein a first and second sorting element 300*a*, 300*b*, in particular a first and second substrate 31*a*, 31*b* of the respective sorting element 300*a*, 300*b*, is connected to the respectively assigned first and second shaft 20*a*, 20*b*, in particular in a positive fit. The shaft 20*a*, 20*b* is embodied to be circular, while the substrate 31*a*, 31*b* is embodied to be elliptical. The first and second fingers 30*a*, 30*b* which are connected to the respective substrate 31*a*, 31*b* are embodied to be equally long in relation to the substrate 31*a*, 31*b*.

A first main axis H1 of the first helical roller 200*a* is arranged such that it is offset by 90° with respect to a second main axis H2 of the second helical roller 200*b*.

LIST OF REFERENCE SIGNS

1 sorting device
2 first helical roller
2' second helical roller
3 sorting element which is attached on the first helical roller
3' sorting element which is attached on the second helical roller
3*a* start piece of the sorting elements
3*e* end piece of the sorting elements
4 insert
10 housing
20 shaft
30 finger of the sorting element which is attached on the first helical roller
30' finger of the sorting element which is attached on the second helical roller
31 substrate of the sorting element which is attached on the first helical roller
31' substrate of the sorting element which is attached on the second helical roller
32 hole
33 transition region
34 cavity
40 first plate
41 second plate
42 connecting region
43 recess
44 bend
310 base body
311 first protrusion
311*a* first contact surface
311*b* second contact surface
312 second protrusion
200*a* first helical roller in accordance with the second embodiment
200*b* second helical roller in accordance with the second embodiment
300*a* first sorting element
300*b* second sorting element
20*a* shaft of the first helical roller
20*b* shaft of the second helical roller
31*a* first substrate
31*b* second substrate
30*a* finger of the first substrate
30*b* finger of the second substrate
D rotational direction
H1 main axis of the first helical roller
H2 main axis of the second helical roller

The invention claimed is:

1. A sorting element for a sorting device, comprising a substrate from which a multitude of fingers project in the radial direction, wherein the fingers are arranged on the substrate along a first helical line, and wherein the substrate includes on at least one axial side a protrusion that extends from a base body of the substrate in a direction of the substrate axis and which defines a first contact surface and a second contact surface for contacting a first and a second counter-contact surface of a protrusion of an adjacent sorting element, respectively, wherein the second contact surface is at least substantially perpendicular to the first contact surface, and wherein the fingers are provided on the base body and the protrusion extending from the base body.

2. The sorting element according to claim 1, wherein the fingers extend on the substrate around a substrate axis.

3. The sorting element according to claim 1, wherein adjacent fingers are separated from each other by a cavity.

4. The sorting element according to claim 1, wherein the fingers are formed from an elastic material.

5. The sorting element according to claim 1, wherein the fingers are embodied to be sickle-shaped and/or a direction of curvature of the fingers is directed oppositely to a rotational direction of the sorting element.

6. The sorting element according to claim 1, wherein the substrate comprises a hole, which is in particular multi-edged or polygonal in cross-section, for coupling to a shaft of a helical roller.

7. The sorting element according to claim 6, wherein an insert for at least partially accommodating the shaft of the helical roller is arranged in the hole.

8. The sorting element according to claim 7, wherein the insert comprises at least two plates which are connected to each other.

9. The sorting element according to claim 1, wherein the substrate comprises a first and/or a second protrusion, wherein the first protrusion and/or the second protrusion protrudes from a side-face of a base body of the substrate in the axial direction of the substrate.

10. The sorting element according to claim 9, wherein the first and second protrusion are arranged on different sides of the substrate in relation to a centre plane of the substrate.

11. The sorting element according to claim 1, wherein a transition region between the finger and the substrate is rounded.

12. The sorting element according to claim 1, wherein at least one finger comprises a wear-resistant end.

13. The sorting element according to claim 1, wherein at least one finger is embodied to be longer than at least one other finger.

14. The sorting element according to claim 1, wherein the sorting element comprises fingers which are arranged along a second helical line on the substrate, wherein the second helical line is arranged offset with respect to the first helical line.

15. A helical roller for a sorting device, comprising at least one sorting element according to claim 1.

16. The helical roller according to claim 15, wherein a shaft of the helical roller is connected to the sorting element integrally and/or a shaft of the helical roller corresponds to the substrate of the sorting element.

17. The helical roller according to claim 16, wherein at least two sorting elements are arranged sequentially on a shaft of the helical roller along an axis of the helical roller.

18. The helical roller according to claim 17, wherein when at least two sorting elements are arranged on the shaft, the first protrusion of one sorting element comes into contact with the second protrusion of an adjacent sorting element.

19. The helical roller according to claim 17, wherein the sorting elements arranged on the helical roller are coupled such that they are rotationally fixed relative to each other.

20. A sorting device, comprising at at least one helical roller according to claim 15.

21. The sorting device according to claim 20, including at least two helical rollers, each of which rotates about a rotary axis of its own and which exhibit the same direction of rotation and/or wherein the helical roller is mounted exclusively at one end.

22. The sorting device according to claim 20, wherein at least two helical rollers form a sorting surface, and a resting zone for the material to be sorted is on the sorting surface, wherein the resting zone extends transverse to an axis of the helical roller.

23. The sorting device according to claim 20, wherein a distance of two helical rollers relative to each other can be set.

24. The sorting device according to claim 20, wherein two helical rollers can be rotated relative to each other.

25. The sorting device according to claim 20, wherein the sorting elements of two adjacent helical rollers interlock.

26. The sorting device according to claim 20, wherein a finger of a sorting element of a first helical roller extends as far as a substrate of a sorting element of a second helical roller.

27. The sorting device according to claim 17, wherein a first main axis (H1) of a first elliptical helical roller is rotated by a predetermined angle with respect to a second main axis (H2) of a second elliptical helical roller which is adjacent to the first helical roller.

28. The sorting device according to claim 1 wherein flanks of the fingers are not parallel to each other but are shifted perpendicular to the radial direction.

* * * * *